US008948675B2

(12) United States Patent
Cardoso et al.

(10) Patent No.: US 8,948,675 B2
(45) Date of Patent: Feb. 3, 2015

(54) IMAGE PINNING FOR SUBSTRATE MEDIA HANDLING

(75) Inventors: George Cunha Cardoso, Webster, NY (US); Martin Krucinski, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 807 days.

(21) Appl. No.: 13/115,515

(22) Filed: May 25, 2011

(65) Prior Publication Data

US 2012/0301196 A1 Nov. 29, 2012

(51) Int. Cl.
*G03G 15/20* (2006.01)

(52) U.S. Cl.
CPC .. *G03G 15/2021* (2013.01); *G03G 2215/00021* (2013.01); *G03G 2215/0129* (2013.01); *G03G 2215/2006* (2013.01)
USPC ..... 399/339; 399/341

(58) Field of Classification Search
USPC ..... 399/339, 341
See application file for complete search history.

(56) References Cited

U.S. PATENT DOCUMENTS

| | | | | |
|---|---|---|---|---|
| 3,519,253 | A | 7/1970 | Aser et al. | |
| 4,363,862 | A * | 12/1982 | Giorgini | 430/124.23 |
| 4,444,486 | A * | 4/1984 | Monkelbaan | 399/339 |
| 4,758,506 | A | 7/1988 | Lok et al. | |
| 5,241,348 | A * | 8/1993 | Garavuso et al. | 399/322 |
| 6,853,813 | B2 * | 2/2005 | Miyazaki | 399/2 |
| 6,859,629 | B2 | 2/2005 | Miura et al. | |
| 6,973,286 | B2 | 12/2005 | Mandel et al. | |
| 7,853,182 | B2 | 12/2010 | Lange | |
| 2008/0075490 | A1 * | 3/2008 | Ota et al. | 399/45 |
| 2009/0274499 | A1 | 11/2009 | Kovacs et al. | |
| 2011/0008722 | A1 | 1/2011 | Wosnick et al. | |

FOREIGN PATENT DOCUMENTS

JP 08272159 A * 10/1996

OTHER PUBLICATIONS

Mitsumizo (JP 08-272159 A), Oct. 1996, JPO Computer Translation.*

* cited by examiner

*Primary Examiner* — Erika J Villaluna
(74) *Attorney, Agent, or Firm* — Hoffmann & Baron, LLP

(57) ABSTRACT

An apparatus for and method of handling substrate media in a marking device using toner. The apparatus including first and second rolls for handling the substrate media. The first roll applying pressure to the toner. After the application of pressure by the first roll, the toner remains partially unfused to the substrate media. The second roll subsequently engaging the pressed toner as the substrate media passes the second roll. The first roll and the second roll being disposed remotely from one another in a process handling direction of the substrate media. The method including the application of pressure to the unfused toner on the substrate media by a first roll. The method subsequently engages the pressed toner with a second roll for handling the substrate media.

9 Claims, 5 Drawing Sheets

IMAGE PINNING FOR SUBSTRATE MEDIA HANDLING

TECHNICAL FIELD

The presently disclosed technologies are directed to apparatus and methods used to handle substrate media in a marking device using toner, such as printing systems. The apparatus and methods described herein use cold-pressure fixing to partially pin unfused toner to a substrate media for subsequent handling prior to fusing.

BACKGROUND

In the process of xerography, a marking material such as toner is generally transferred to a substrate media sheet with the substrate media sheet then being transported to a fusing system for permanently binding the toner to the substrate media. The binding of toner particles on to the substrate media, which is typically referred to as fusing, generally demand that the toner carried by the substrate media remain untouched or undisturbed prior to the fusing stage. Accordingly, sheets of substrate media after receiving toner are generally transported immediately to a fuser over a very short media path in order to avoid any unwanted contact with the toner image.

In order to fuse toner onto a substrate media sheet, such as paper, xerographic printers typically incorporate a device called a fuser. While fusers can take many forms, heat or a combination of heat and pressure fusers are currently most common. Using a heat fusing roll in combination with an adjacent pressure roll is one example of such a combination fuser. Such combined rolls, typically applying pressures between 10 and 200 psi, cooperate to form a fusing nip through which the paper carrying toner passes. The heat at least partially melts the toner and the pressure helps force it to bind with the paper. Heat fusing generally requires temperatures above room temperature, reaching as high as 175 degrees Celsius. The lower end of that temperature range generally requires higher pressure be applied in addition to the heat.

Another technique of fusing is known as cold-pressure fixing. Cold-pressure fixing relies primarily on pressure to secure the toner to the substrate. In this way, cold-pressure fixing generally consists of squeezing a substrate sheet carrying toner between two solid rolls. While requiring pressure between the two rolls, cold-pressure fixing can generally be performed between 10-65 degrees Celsius, which includes temperatures at or near room temperature. In contrast, other forms of fusing require significantly higher levels of energy for generating heat. While, conventional cold-pressure fixing systems use a relatively high level of pressure in order to permanently fix the toner to the substrate media, the energy and or costs associated with the process is substantially less than that required for other fusing techniques. However, conventional cold-pressure fixing systems are also known for either significant smearing or adding an unintentional gloss, thus negatively affecting image resolution or quality.

FIG. 8 shows a tightly integrated parallel processing (TIPP) assembly 800 where toner is immediately fused to sheets of substrate media after each individual marking engine ME deposits toner thereon. As shown, individual subassemblies 802, 804, 806, 808 each include their own marking engine ME. The individual marking engines ME include very short media paths that immediately lead to an internal heating fuser 80. In this way, between the initial sheet feeder 7 and the eventual sheet finisher 9, the overall assembly 800 includes a plurality of high energy consuming heat fusing devices 80 in order to achieve its parallel processing. One reason for the individual heated fusers 80 is to relieve concerns with regard to images conveyed along the extensive sheet path 2 and across the numerous handling sensors 810 and rolls 820 within the greater assembly 800. However, such heated fusers 80 can be made to reach as high as 200 degrees Celsius. Thus, such high energy heat fusers 80 are not only a source of energy consumption, but also each have maintenance costs associated with them as well.

Accordingly, it would be desirable to provide an apparatus and method for handling substrate media in a marking device using toner that is efficient, cost effective and overcomes the various shortcomings of the prior art.

SUMMARY

According to aspects described herein, there is disclosed an apparatus for handling substrate media in a marking device using toner. The apparatus including a first roll for pressing toner on a substrate media. The first roll applying pressure to the toner, whereby the toner remains partially unfused to the substrate media. The apparatus also including a second roll for handling the substrate media. The second roll engaging the pressed toner as the substrate media passes the second roll. The first roll and the second roll being disposed remotely from one another in a process handling direction of the substrate media.

According to other aspects described herein, the first roll can include a toner engagement surface protruding from the first roll. The toner engagement surface can directly engaging the toner to apply the pressure. The toner engagement surface can be substantially centered relative to a cross-process direction of the substrate media. Alternatively, the first roll can include more than one separate toner engagement surface protruding from the first roll. Each of the toner engagement surfaces can be adapted to directly engage the toner to apply the pressure. Each of the toner engagement surfaces can be disposed offset from a center in a cross process direction of the substrate media. Additionally, the first roll can include opposed rounded lateral edges preventing disturbance to the toner relative to the substrate media in a region the lateral edges contact the toner. Also, the substrate media can convey additional unfused toner not engaged by the first roll. The first roll can be made to apply less than 5 kpsi of pressure to the toner. The apparatus can also include a heat fusing device for receiving the substrate media after passing the second roll. The heat fusing device can substantially fuse the toner to the substrate media.

According to other aspects described herein, there is disclosed an apparatus including a first and second station. The first station including a first pinning roll and a first handling roll. The first pinning roll applying pressure to a first toner on a substrate media, whereby the first toner remains partially unfused to the substrate media. The first handling roll engaging the pressed first toner as the substrate media passes the first handling roll subsequent to the first pinning roll. The second station including a second pinning roll and a second handling roll. The second pinning roll applying pressure to a second toner on the substrate media, whereby the second toner remains partially unfused to the substrate media. The second handling roll engaging the pressed second toner as the substrate media passes the second handling roll. The first station and the second station being disposed remotely from one another in a process handling direction of the substrate media. The apparatus also including a fuser applying heat to the first toner and the second toner subsequent to the substrate media passing the first station and the second station.

According to other aspects described herein, the first and second pinning rolls can each include a toner engagement surface protruding from the respective rolls. Each toner engagement surface can directly engage the toner to apply the pressure. Also, each toner engagement surface can be substantially centered relative to a cross-process direction of the substrate media. The first and second pinning rolls can each include more than one separate toner engagement surface protruding from the respective rolls. Each of the toner engagement surfaces can be adapted to directly engage the toner to apply the pressure. Each of the toner engagement surfaces can be disposed offset from a center in a cross process direction of the substrate media. Additionally, the substrate media can convey additional unfused toner not engaged by at least one of the first pinning roll and the second pinning roll. Also, the first pinning roll can apply less than 5 kpsi of pressure to the toner.

According to other aspects described herein, there is disclosed an apparatus including a first station, a second station and a single fuser. The first station including a first pinning roll and a first handling roll. The first pinning roll applying pressure to a first toner on a first substrate media, whereby the first toner remains partially unfused to the first substrate media. The first handling roll engaging the pressed first toner as the first substrate media passes the first handling roll subsequent to the first pinning roll. The second station including a second pinning roll and a second handling roll. The second pinning roll applying pressure to a second toner on a second substrate media, whereby the second toner remains partially unfused to the second substrate media. The second handling roll engaging the pressed second toner as the second substrate media passes the second handling roll. The first station and the second station being disposed remotely from one another and adapted to process the first substrate media and the second substrate media contemporaneously. The fuser applying heat separately to the first toner and the second toner in series. The respective applications of heat, fusing the first toner to the first substrate media and the second toner to the second substrate media.

According to other aspects described herein, the first station pinning roll can include a toner engagement surface protruding from the first station pinning roll. The toner engagement surface can directly engage the first toner to apply the pressure. Also, the toner engagement surface can be substantially centered relative to a cross-process direction of the first substrate media. The first station pinning roll can include more than one separate toner engagement surface protruding from the first pinning roll. Each of the toner engagement surfaces can be adapted to directly engage the first toner to apply the pressure. Further, each of the toner engagement surfaces can be disposed offset from a center in a cross process direction of the first substrate media. The first substrate media can also convey additional unfused toner not engaged by the first station pinning roll. Further still, the first station pinning roll can apply less than 5 kpsi of pressure to the first toner.

According to further aspects described herein, there is disclosed a method of handling a substrate media in a marking device. The method includes applying pressure to unfused toner disposed on a substrate media using a first roll. The toner remaining partially unfused to the substrate media after the application of pressure. The method also including conveying the substrate media in a process direction from the first roll to a second roll disposed remote from the first roll. The substrate media being handled using the second roll, where the second roll engages the pressed toner.

The first roll can also be disposed substantially in a central region of the substrate media relative to a cross process direction. Alternatively, the first roll can be disposed relative to the substrate media in an offset position from a center of the substrate media in a cross process direction.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
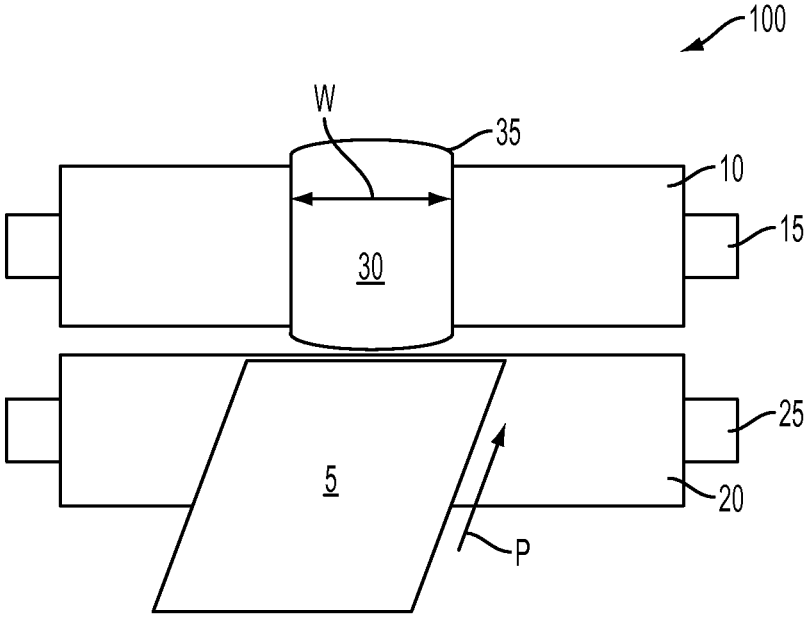
FIG. 1 is a schematic front elevation view of a cold-pressure fixing nip assembly showing an approaching substrate media sheet in accordance with an aspect of the disclosed technologies.

Describing now in further detail exemplary embodiments with reference to the Figures, as briefly described above. The disclosed technologies employ one or more fixing rolls that press at least portions of unfused toner on a substrate media, leaving it partially unfused. Relatively low pressure, cold-pressure fixing rolls are used to improve media handling and reduce the number of high energy fusing devices needed in an overall imaging system and provide flexibility in designing media handling path in such a system.

As used herein, a "media handling assembly" refers to one or more devices used for handling and/or transporting substrate media, including feeding, marking, printing, finishing, registration and transport systems.

As used herein, a "marking device," "printer," "printing assembly" or "printing system" refers to one or more devices used to generate "printouts" or a print outputting function, which refers to the reproduction of information on "substrate media" for any purpose. A "marking device," "printer," "printing assembly" or "printing system" as used herein encompasses any apparatus, such as a digital copier, bookmaking machine, facsimile machine, multi-function machine, and the like, which performs a print outputting function for any purpose.

Particular marking devices include printers, printing assemblies or printing systems, which can use an "electrostatographic process" to generate printouts, which refers to forming an image on a substrate by using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink process, and the like. Also, a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction.

As used herein, "toner" refers to the electrostatic marking particles commonly deposited onto a photosensitive member in a xerographic process. Toner particles are generally formed from plastic, polymer, carbon-based material and/or other like materials. The particles generally have a diameter of between 3 μm and 40 μm, used to develop images on a substrate.

As used herein, a "fuser" and "fusing" refers to applying energy of one or more types to cause the marking material such as toner to attach to the substrate media with a permanence sufficient for a practical or commercial purpose. This includes fixing toner on a substrate by melting the toner thereon, pressing the melted toner onto the substrate and fixing the toner on the substrate by a combination of the pressure applied and capillary force exerted by the substrate's texture on the fluidized melted toner. As used herein, "partially fusing" or "partially fused" refers to fixing toner on a substrate without substantial impregnation of the toner in the substrate. Partial fusing includes any process where the binding force of the toner to the substrate is less than the bonding force normally found in conventionally fused toner.

As used herein, a "roll," "roller" or "wheel" refers to a generally cylindrical element able to revolve or re-circulate about a longitudinal axis thereof. Rolls as referred to herein are generally intended to interact with substrate media sheets made to come in contact or in close proximity there with. Also, as used herein, a "nip assembly" or "nip assemblies" refers to an assembly of elements that include at least two adjacent revolving or recirculating elements and supporting structure, where the two adjacent revolving or recirculating elements are adapted to matingly engage opposed sides of a transfer belt or substrate media. A typical nip assembly includes two wheels or cylindrical rolls that cooperate to drive or handle a substrate therebetween. One or two of the opposing wheels can include a driven wheel, one or two of the opposing wheels can be a freely rotating idler wheel or the opposed wheels can be a combination thereof. Together the two wheels guide or convey the transfer belt or other substrate within a media handling assembly. More than two sets of mating wheels can be provided in a laterally spaced configuration to form a nip assembly. It should be further understood that such wheels are also referred to interchangeably herein as rolls or rolls. Once a substrate is engaged between the opposed revolving or recirculating elements, the space or gap between them is referred to as the "nip" or "nip gap".

As used herein, the term "belt" or "transfer belt" refers to, for example, an elongated flexible web supported for movement along a process flow direction. For example, an image transfer belt is capable of conveying an image in the form of toner for transfer to a substrate media. Another example includes a media transfer belt, which preferably engages and/or conveys a substrate media within a printing system. Such belts can be endless belts, looping around on themselves within the printing system in order to continuously operate. Accordingly, belts move in a process direction around a loop in which they circulate. A belt can engage a substrate media and/or carry an image thereon over at least a portion of the loop. Image transfer belts for carrying an image or portions thereof can include non-stretchable electrostatic or photoreceptor belts capable of accumulating toner thereon.

As used herein, the terms "process" and "process direction" refer to a process of moving, transporting and/or handling an image or substrate media conveyed by a transfer belt. The process direction substantially coincides with a direction of a flow path P along which the image or substrate media is primarily moved within the media handling assembly. Such a flow path P is said to flow from upstream to downstream.

The apparatus and methods in accordance with aspects of the disclosed technologies relate to handling xerographic prints in a substrate media path where the substrate media carries unfused marking material such as toner. Using cold-pressure fixing techniques, all or part of the toner on the substrate media can be pinned, thereby enabling more robust handling of the substrate media before the toner is fully fused thereon. By pinning the toner using relative low pressure, the toner image avoids disturbance and the substrate media carrying unfused toner can be conveyed further and manipulated more dramatically without a significant reduction in image quality. Such an apparatus and associated method can thus reduce the cost, energy consumption and maintenance requirements of numerous intermediate heat fusers.

FIG. 1 shows an exemplary cold-pressure fixing nip assembly 100 in accordance with an aspect of the disclosed technologies. The assembly 100 includes a cold-pressure roll 10 for applying pressure directly to the toner deposited on sheet 5. While such a roll 10 can generally be formed from stainless steel and supported by a suitable axial shaft 15, it should be understood that other materials could be alternatively employed as suited for a particular application. As with contemporary nip assemblies, an adjacent parallel roll 20 and its supporting axial shaft 25 are disposed to receive a sheet 5 there between. FIG. 1 illustrates a substrate media sheet 5 approaching the nip gap between the two rolls 10, 20 in a process direction P. Toner can be covering anywhere on the surfaces of the substrate media 5, including covering the entire surface or more limited portions thereof.

As a further aspect of the disclosed technologies, the upper roll 10 can be provided with a toner engagement surface 30, specifically designed for cold-pressure fixing. In this way, a select extent of the cold-pressure roll 10 is used to engage the substrate media. This also allows for a more limited engagement with the toner carried by the substrate media. The particular width W of the cold-pressure fixing surface 30 will determine what portion of the substrate media 5 will get engaged. Thus, any toner disposed in that engaged portion would get cold pressed. It should be understood that the width W could be greater or smaller than the proportional width illustrated. The engagement surface width W can be made wider than the lateral width of the toner area on the substrate media. In fact, the engagement surface width W could even be made wider than the lateral width of the substrate media itself. In contrast, the engagement surface width W can alternatively be less than a lateral dimension of the toner disposed on the substrate media 5. In this way, the engagement surface 30 is designed to only engage a portion of the toner contained on sheet 5. Alternatively, the entire width of the roll 10 along its axis can be coated for engagement. Similarly, the entire width of the roll 10 could be narrower and thus limit the area of engagement.

The engagement by surface 30 with the toner is intended to tack the toner to the substrate media without using a heating process. Tacking the toner leaves it partially unfused and makes it less secure than conventional fusing techniques. In this way, the pressure supplied by the engagement surface 30 is preferred below 10 kpsi, and can even be provided below 5 kpsi, in order to avoid stress conditions or high gloss differential in the finished toner image. It should be noted that in accordance with an aspect of the disclosed technologies, the engagement surface 30 can be disposed substantially centrally in a cross-process direction relative to the passing substrate media 5. However, if desirable, the engagement surface 30 could be offset from a central position in the cross-process direction.

A further aspect of the disclosed technologies includes providing beveled or rounded edges 35 for the engagement surface 30 on the cold-pressure fixing roll 10. Such beveled or rounded edges provide a softer transition between cold-pressure fixed toner and non-tacked toner. Thus, the beveled or rounded edges 35 avoid the creation of unintentional lines or linear distortions in the toner that forms the overall image on substrate media. Such soft edges 35 are advantageous where the engagement surface 30 is intended to engage only a portion of the overall toner disposed on the substrate media sheet 5.

Figure 2:
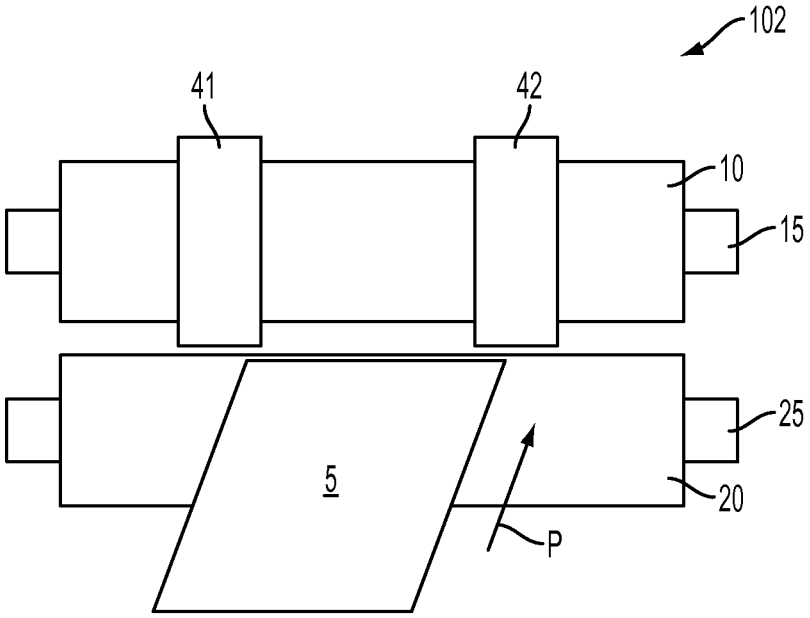
FIG. 2 is a schematic front elevation view of a cold-pressure fixing nip assembly in accordance with a further aspect of the disclosed technologies.

FIG. 2 shows a further alternative embodiment of the disclosed technologies wherein more than one separate toner engagement surface 41, 42 is included on the pressure roll 10. In this alternative, cold-pressure fixing nip assembly 102 includes laterally spaced engagement surfaces 41, 42 intended to engage the outer edges of the substrate media sheet 5 and the corresponding toner that is disposed near those edges. It should be understood that a greater number of such discreet engagement surfaces 41, 42 could be provided. Also, the separate engagement surfaces 41, 42 need not be disposed coincident with the sheet edges. Thus, the engagement surfaces 41, 42 could be more centrally disposed relative to the sheet edges. Also, as described above the width of the engagement surfaces could be designed greater or smaller than that depicted. Also, the different engagement surfaces need not have the same width, although the embodiment illustrated includes two engagement surfaces with equal widths.

Figure 3:
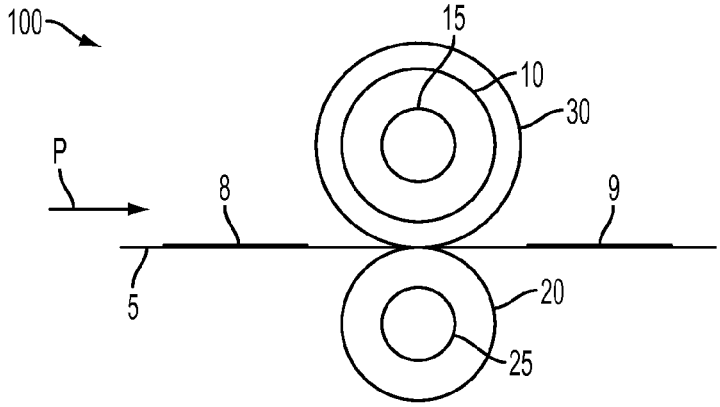
FIG. 3 is a schematic side elevation view of the cold-pressure fixing nip assembly of FIG. 1, with the substrate media engaged by the nip assembly.

FIG. 3 shows a side elevation view of the cold-pressure fixing assembly 100 similar to that in FIG. 1. In contrast to FIG. 1, the substrate media sheet 5 in FIG. 3 has progressed further along the process direction P, so that the sheet is disposed between the upper roll 10 and lower roll 20. FIG. 3 further differs in that the substrate media is depicted as only partially containing toner marking material 8, 9 in select portions of a surface of the sheet 5. As shown, toner area 9 has already been engaged by the cold-pressure fixing surface 30 and is thus partially fixed to the substrate media 5. However, toner area 8 has not yet passed through the cold-pressure fixing nip and represents unfused toner marking material. Thus, the unfused toner, while carried by the substrate, is at least temporarily unfused thereon and no substantial force has been applied binding the toner to the substrate. Preferably, suitable toner is used that can be fixed to the applicable substrate through pressure. Typically emulsion aggregation (EA) type toner is used in this regard, but it should be understood that almost any toner suitable for cold-pressure fixing could be used.

Figure 4:
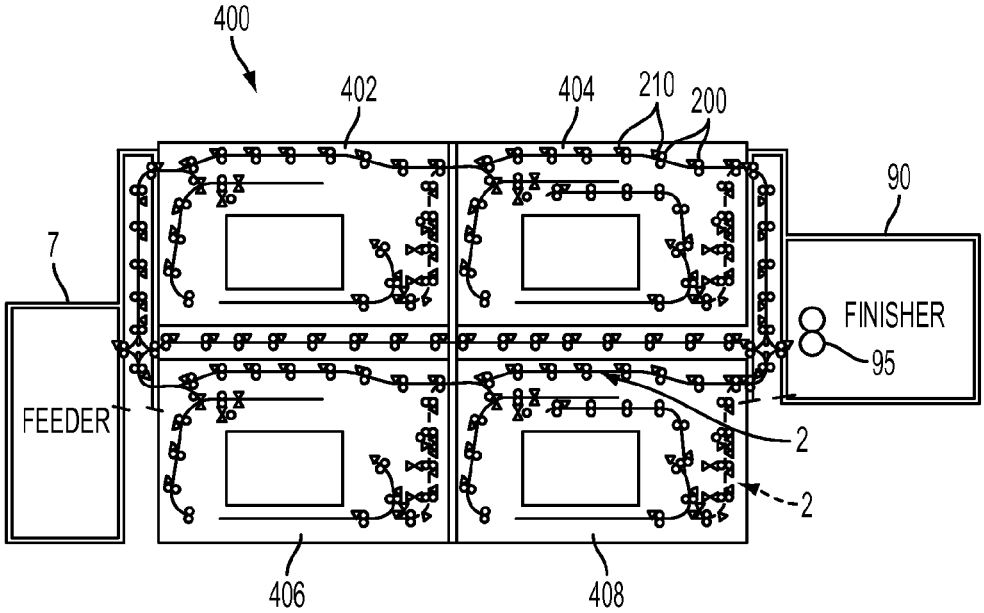
FIG. 4 is a schematic side elevation view of a media handling assembly including multiple image marking devices in conjunction with a shared fusing device, in accordance with a further aspect of the disclosed technologies.
Figure 8:
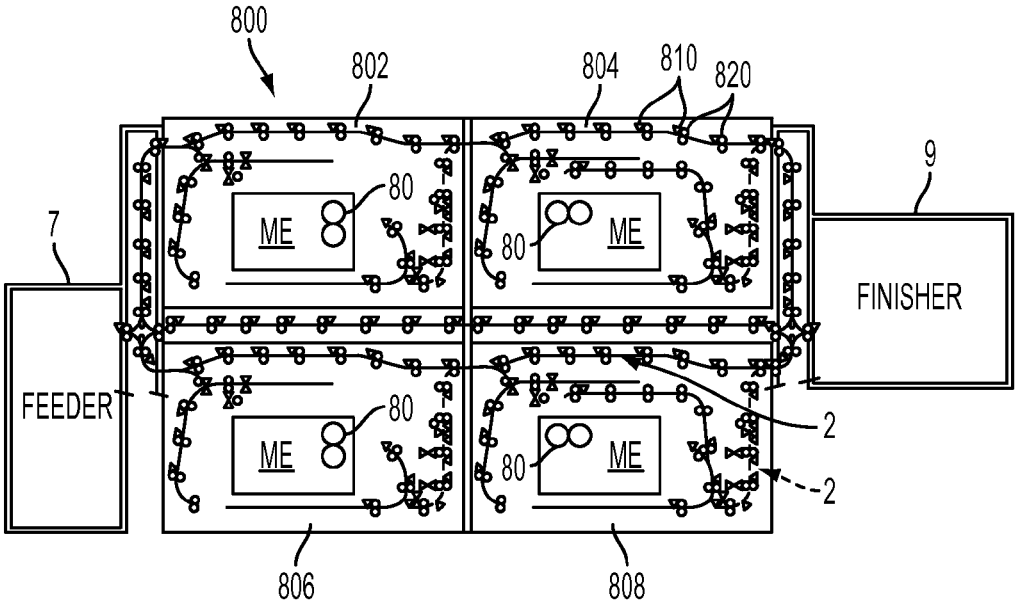
FIG. 8 PRIOR ART
FIG. 8 shows a side elevation view of a prior art system including multiple marking engines, each having their own heat fusing sub-assemblies.

In accordance with a further aspect of the disclosed technologies, FIG. 4 shows a side elevation view of a TIPP xerographic assembly 400 that shares a single heated fusing element 95. In contrast to the assembly 800 shown in FIG. 8, the assembly 400 need not provide multiple heat fusers. Rather, a single heat fuser 95 is provided for the subassemblies 402, 404, 406, 408 to share. Although not shown, each of the subassemblies 402, 404, 406, 408 can include a cold-pressure fixing nip assembly. In this way, when the substrate media carrying toner is subsequently handled along the media path 2, the partially fixed toner can be handled along the extensive sheet path 2 and across the numerous handling sensors 410 and rolls 420 within the greater assembly 400. Such low-energy cold-pressure fixing subassemblies (not shown in FIG. 4) can be more cost effective as compared to the same number of individual heat fusers.

Figure 5:
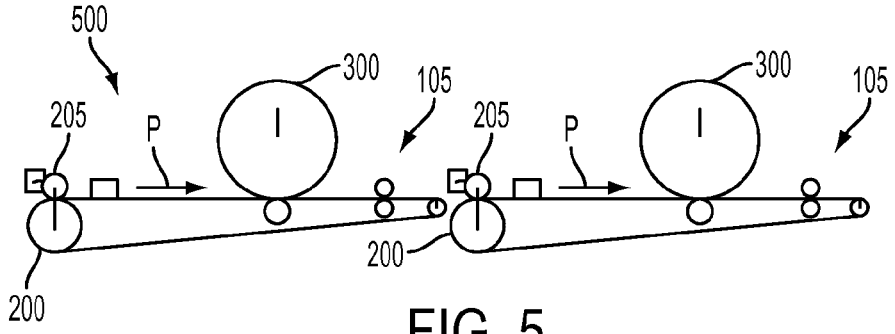
FIG. 5 is a schematic side elevation view of a modular overprint configuration including multiple cold-pressure fixing subassemblies in accordance with further aspects of the disclosed technologies.

FIG. 5 represents a schematic side elevation view of a modular overprint press 500 with two electrostatic transfer belts 200 used for conveying sheets of substrate media along the process path P. As with typical marking engines, a handling nip 205 can be used to engage the sheet and steer it toward the marking device 300. The steering and/or speed changes are generally done in order to correct tiny skew and other characteristics of the sheet before it is printed upon. In accordance with an aspect of the disclosed technologies, a cold-pressure fixing roll 105 can be used to tack portions of the unfused toner, enabling the substrate media to be handled by a further down-stream nip assembly 205 before moving to the next modular overprint station.

Figure 6:
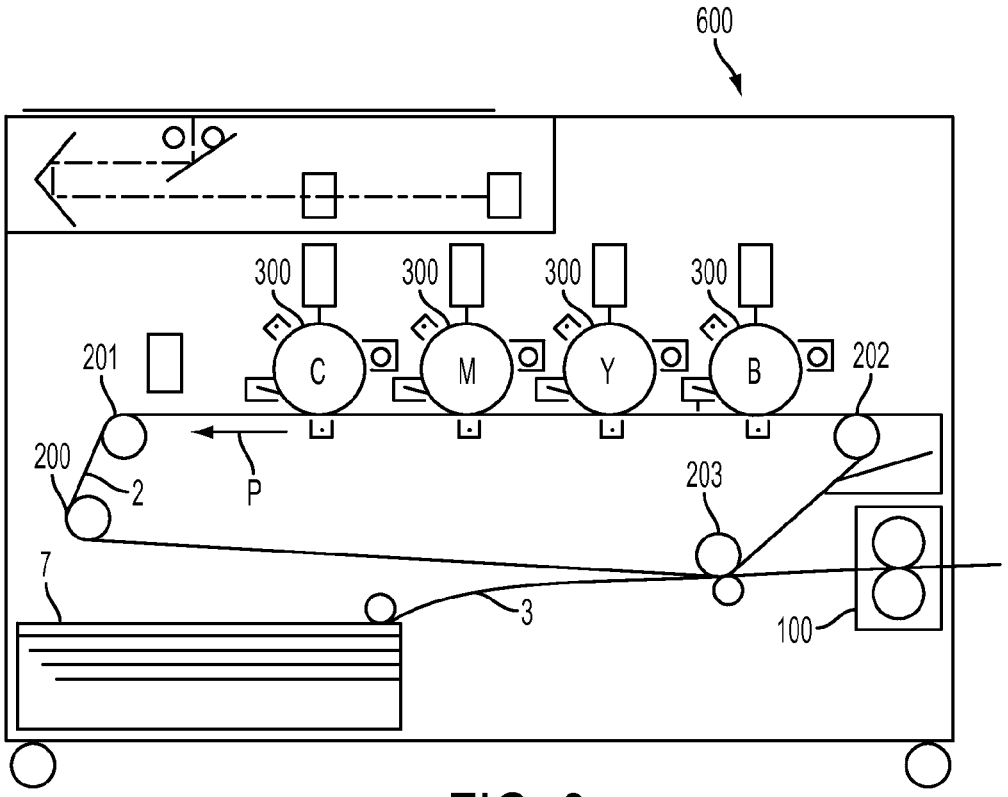
FIG. 6 shows a schematic side elevation view of a self-contained modular printing assembly including a cold-pressure fixing nip assembly in accordance with aspects of the disclosed technologies.

FIG. 6 illustrates a single modular marking device 600 that includes a modular overprint architecture using an intermediate transfer belt 2. The individual multicolor marking devices 300 compile toner on the intermediate transfer belt 2 which is supported by various rolls 200, 201, 202, 203. The compiled toner is conveyed in a process direction P and deposited at roll 203 on a substrate media sheet supplied from a feeder 7 and conveyed along sheet handling path 3. Thereafter, in accordance with an aspect of the disclosed technologies a cold-pressure fixing assembly 100 can be incorporated within the modular assembly. As with the embodiment shown in FIG. 4, a modular assembly 600 can be joined with others like it that together can share the same heat fusing unit.

Figure 7:
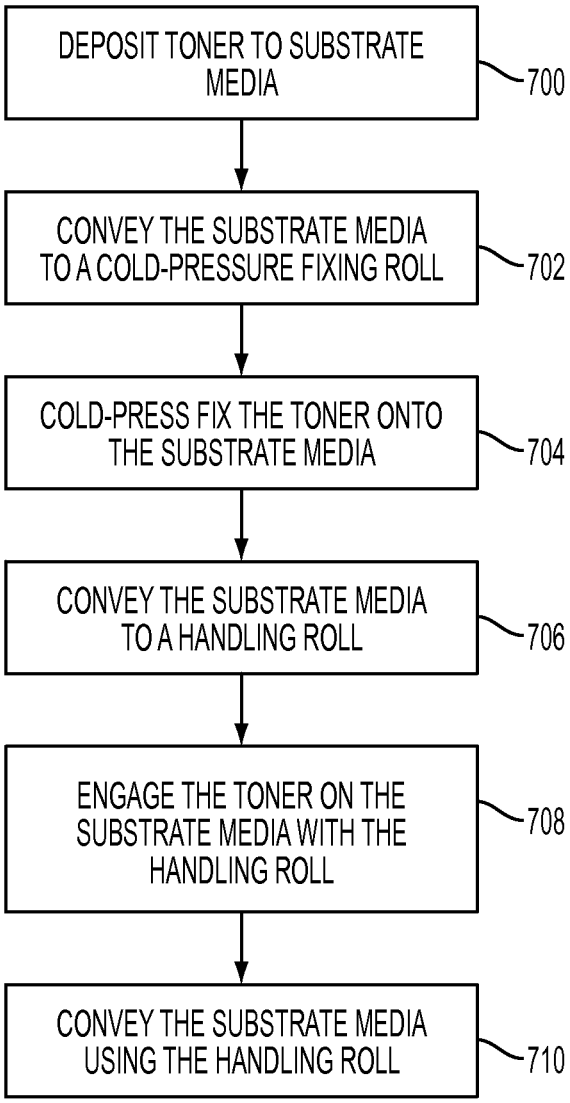
FIG. 7 illustrates a flow chart depicting a method of handling a substrate media in a marking device in accordance with aspects of the disclosed technologies.

FIG. 7 illustrates a process flow in accordance with the methods disclosed herein. At 700 toner is deposited on substrate media and the substrate media conveyed to a cold-pressure fixing roll at 702. At 704, the cold-pressure fixing roll applies low pressure to at least a portion of the toner disposed on the substrate media. Thereafter at 706 the substrate media is conveyed to a further handling roller 706. The handling roller can include one or more of a series of handling rollers. The cold-pressure fixing technique disclosed herein allows at least a portion of the cold-pressure fixed toner to actually be engaged by a handling roll at 708. Also, such handling rolls can even be used to convey the substrate media at 710. It should be understood that additional handling rolls that do not engage the toner can also be used.

It will be appreciated that various of the above-disclosed and other features and functions, or alternatives thereof, may be desirably combined into many other different systems or applications. It will also be appreciated that various presently unforeseen or unanticipated alternatives, modifications, variations, or improvements therein may be subsequently made by those skilled in the art which are also intended to be encompassed by the disclosed embodiments and the following claims.

What is claimed is:

1. An apparatus for handling substrate media in a marking device using toner, the apparatus comprising:

a first roll for pressing a first toner on a first side of a substrate media, the first roll applying pressure to the first toner, whereby the first toner remains partially unfused to the substrate media;

a second roll for handling the substrate media, the second roll engaging the partially unfused first toner as the substrate media passes the second roll, the first roll and the second roll being disposed remotely from one another in a process handling direction of the substrate media;

a third roll for pressing a second toner on the first side of the substrate media, the third roll applying pressure to the second toner, whereby the second toner remains partially unfused to the substrate media;

a fourth roll for handling the substrate media, the fourth roll engaging the partially unfused second toner as the substrate media passes the fourth roll, the third roll and the fourth roll being disposed remotely from one another in a process handling direction of the substrate media; and a heat fusing device for receiving the substrate media after passing the fourth roll, the heat fusing device substantially fusing the partially unfused first and second toners to the substrate media.

2. The apparatus of claim 1, wherein the first roll includes a toner engagement surface protruding from the first roll, the toner engagement surface directly engaging the first toner to apply the pressure, the toner engagement surface being substantially centered relative to a cross-process direction of the substrate media.

3. The apparatus of claim 1, wherein the first roll includes more than one separate toner engagement surface protruding from the first roll, each of the toner engagement surfaces adapted to directly engage the first toner to apply the pressure, each of the toner engagement surfaces being disposed offset from a center in a cross process direction of the substrate media.

4. The apparatus of claim 1, wherein the first roll includes opposed rounded lateral edges preventing disturbance to the first toner relative to the substrate media in a region the lateral edges contact the first toner.

5. The apparatus of claim 1, wherein the substrate media conveys additional unfused first toner not engaged by the first roll.

6. The apparatus of claim 1, wherein the first roll is a cold-pressure fixing roll applying less than 5 kpsi of pressure to the first toner.

7. The apparatus of claim 1, wherein the first roll is disposed substantially in a central region of the substrate media relative to a cross process direction.

8. The apparatus of claim 1, wherein the first roll is disposed relative to the substrate media in an offset position from a center of the substrate media in a cross process direction.

9. A method of handling a substrate media in a marking device, the method comprising:

applying pressure to unfused first toner disposed on a first side of a substrate media using a first roll, the first toner remaining partially unfused to the substrate media after the application of pressure;

conveying the substrate media in a process direction from the first roll to a second roll disposed remote from the first roll;

handling the substrate media using the second roll, the second roll engaging the pressed first toner;

applying pressure to unfused second toner disposed on the first side of the substrate media using a third roll, the second toner remaining partially unfused to the substrate media after the application of pressure;

conveying the substrate media in a process direction from the third roll to a fourth roll disposed remote from the third roll;

handling the substrate media using the fourth roll, the fourth roll engaging the pressed second toner; and receiving the substrate media after passing the fourth roll in a heat fusing device that substantially fuses the partially unfused first and second toners to the substrate media.

* * * * *